United States Patent [19]

Chrostowski et al.

[11] 4,389,851

[45] Jun. 28, 1983

[54] METHOD FOR DEFROSTING A HEAT EXCHANGER OF A REFRIGERATION CIRCUIT

[75] Inventors: Ronald F. Chrostowski, Liverpool; Rudy C. Bussjager, Syracuse; James J. Del Toro, North Syracuse, all of N.Y.

[73] Assignee: Carrier Corporation, Syracuse, N.Y.

[21] Appl. No.: 289,342

[22] Filed: Aug. 3, 1981

Related U.S. Application Data

[62] Division of Ser. No. 112,876, Jan. 17, 1980, Pat. No. 4,313,313.

[51] Int. Cl.[3] ..... F25D 21/06

[52] U.S. Cl. ..... 62/81; 62/155; 62/196 B; 62/278

[58] Field of Search ..... 62/81, 278, 160, 196 B, 62/324.5, 155, 156

[56] References Cited

U.S. PATENT DOCUMENTS

| | | | |
|---|---|---|---|
| 2,878,654 | 3/1959 | Kramer | 62/278 |
| 3,273,635 | 9/1966 | Jobes | 62/154 |
| 3,822,564 | 7/1974 | Nijo | 62/196 B |

*Primary Examiner*—Albert J. Makay

*Assistant Examiner*—Harry Tanner

*Attorney, Agent, or Firm*—Donald F. Daley; Robert P. Hayter

[57] ABSTRACT

Apparatus and a method for providing a combination of non-reverse and reverse defrost for a refrigeration circuit are disclosed. A three-way valve is provided for initially circulating hot gaseous refrigerant directly from the compressor to the heat exchanger requiring defrost. An intermediate header is provided as part of the internal circuiting of the outdoor heat exchanger, said intermediate header serving to direct hot gaseous refrigerant from the three-way valve into all of the circuits of the outdoor heat exchanger simultaneously to effect defrost thereof. If, after a predetermined time period, the first mode of defrost directing hot gaseous refrigerant directly to the outdoor heat exchanger fails to accomplish defrost then the three-way valve is returned to its original position and the system is operated in a second defrost mode with the reversing valve being changed such that the system operates in the cooling mode and the outdoor heat exchanger serves as a condenser until defrost is completed. During the first mode of defrost, a liquid line solenoid valve is used to prevent the flow of refrigerant between the indoor heat exchanger and the outdoor heat exchanger.

5 Claims, 2 Drawing Figures

METHOD FOR DEFROSTING A HEAT EXCHANGER OF A REFRIGERATION CIRCUIT

This application is a division, of application Ser. No. 112,876, filed Jan. 17, 1980 now U.S. Pat. No. 4,313,313.

BACKGROUND OF THE INVENTION

1. Field of the Invention

This invention relates in general to refrigeration circuits and more particularly to a defrost system for use in a refrigeration circuit such as may be incorporated in air conditioning apparatus including a heat pump.

2. Prior Art

The conventional refrigeration circuit employs a compressor, condenser, expansion means and evaporator connected to form a refrigerant flow circuit. The compressor raises the pressure and temperature of gaseous refrigerant and the gaseous refrigerant is then conducted to the condenser wherein it gives off heat to a cooling fluid and is condensed to a liquid. The liquid refrigerant then flows through an expansion means such that its pressure is reduced and is therefor capable of changing from a liquid to a gas absorbing heat during the change in state. A complete change of state from a liquid to a gas occurs in the evaporator and heat is removed from the media flowing in heat transfer relation with the evaporator. Gaseous refrigerant from the evaporator is then conducted back to the compressor.

Under appropriate ambient conditions, the media flowing in heat transfer relation with the evaporator, typically air, has its temperature lowered below its dew point. Once the temperature of the air is below the dew point, moisture is deposited on the coil surfaces resulting in a collection of fluid thereon. If the ambient temperature conditions are sufficiently low or if the temperature of the evaporator is sufficiently low, then ice is formed on the heat exchanger surfaces. Once this ice or frost coats the surfaces of the heat exchanger, the efficiency of the heat exchanger is impaired and overall system efficiency decreases. Consequently, it is desirable to maintain the evaporator surfaces free from ice or frost.

The formation of ice or frost on the heat exchanger surface is particularly accute with heat pumps used to provide heating to an enclosure. In the operation of the heat pump in the heating mode, the outdoor coil functions as an evaporator such that heat may be absorbed from the outside air. If the outside air is at a low temperature, the evaporator must operate at an even lower temperature and consequently it may operate under the appropriate environmental conditions such that ice and frost are formed thereon.

Many systems have been developed for defrosting heat exchanger coils. These include supplying electric resistance heat to the coil surface to melt the ice and reversing the refrigeration system such that hot gas discharged from the compressor is circulated through the evaporator to melt the ice thereon. The inconvenience accompanying reversing the system is that heat is removed from the enclosure to supply heat energy for defrost.

Nonreverse defrost systems, systems which do not include a reversal in the flow path of refrigerant through the refrigeration circuit, have been previously utilized and are disclosed in the art. Most of these systems concern bypassing the condenser such that hot gas from the compressor is discharged directly into the evaporator and then some method is used to vaporize the refrigerant which has liquified in the evaporator in order to maintain superheat in the refrigerant so that it never changes from a gas to a liquid.

In the present defrost system, a combination of reverse and nonreverse defrost is utilized to provide for effective frost removal from the heat exchanger. A three-way valve is mounted in series with a four-way valve such that the four-way valve is utilized to direct refrigerant flow to operate the system in either the heating or cooling mode of operation. Typically defrost of the outdoor heat exchanger of a heat pump is accomplished by operating the heat pump in the cooling mode such that heat energy is supplied by hot gaseous refrigerant from the condenser directly to the outdoor heat exchanger serving as the evaporator during the heating mode. Consequently, the operation of the refrigeration system is reversed and the indoor heat exchanger which should be supplying heat during the heating mode is acting as an evaporator and removing heat from the enclosure to be conditioned.

Herein a three-way valve is provided between the compressor and the four-way valve such that hot gaseous refrigerant from the compressor is either discharged to the four-way valve or discharged directly to the heat exchanger to be defrosted. An intermediate header conducts the hot gaseous refrigerant via feeder tubes into each circuit of the outdoor heat exchanger. The intermediate header further serves during normal operation to conduct the refrigerant between the circuits of the heat exchanger when it is serving as a condenser and as a part of the refrigerant flow path when the heat exchanger is operating as an evaporator, said intermediate header connecting the expansion means to the circuits of the heat exchanger. The three-way valve is energized to supply heat energy directly from the compressor to the outdoor heat exchanger such that gaseous refrigerant is circulated between the outdoor heat exchanger and the compressor for a predetermined time period. If defrost is not accomplished within that time period then the three-way valve is repositioned such that hot gaseous refrigerant is provided to the reversing valve which is then switched to the cooling mode to complete defrost of the heat exchanger. A solenoid valve is provided in the liquid line between the indoor heat exchanger and the outdoor heat exchanger such that during the initial defrost mode with the three-way valve being repositioned to direct hot gaseous refrigerant directly to the outdoor heat exchanger, refrigerant flow between the indoor heat exchanger and the outdoor heat exchanger is prevented.

The utilization of a two step defrost provides a demand defrost system wherein the first mode of defrost checks to determine if defrost is really necessary as well as melting some ice accumulation. If defrost is not necessary, the temperature of the heat exchanger will rise shortly after the three-way valve is positioned for defrost and defrost will be terminated. Hence, a defrost system is provided which verifys the need for defrost on a periodic basis as well as providing means to accomplish defrost. During this first mode of operation to ascertain the necessity of defrost no heat is removed from the enclosure and heating operations may continue without the reversing valve changing position if no major frost accumulation is detected.

SUMMARY OF THE INVENTION

It is an object of the present invention to provide a nonreverse defrost system.

It is a further object of the present invention to provide a combination nonreverse and reverse defrost system.

It is a yet further object of the present invention to provide a defrost system for a heat exchanger wherein pressures are maintained substantially equal on each side of the four-way valve such that cycling of the four-way valve may be accomplished without the valve undergoing large pressure changes.

It is another object of the present invention to provide an intermediate header for conducting hot gaseous refrigerant for defrost of a heat exchanger while simultaneously having the header serve part of the refrigerant circuiting within the heat exchanger and for conducting refrigerant from an expansion means to the heat exchanger.

It is a further object of the present invention to provide a control system for a nonreverse defrost system as described herein.

It is another object of the present invention to periodically ascertain whether there is a demand for reverse cycle defrost operation.

It is a yet further object of the present invention to provide a safe, economical, reliable, easy to manufacture and easy to service refrigeration circuit incorporating a combination of reverse and nonreverse defrost modes.

These and other objects of the present invention are achieved utilizing a three-way valve in combination with a reversing valve such that initial defrost of a heat exchanger is accomplished by directing hot gaseous refrigerant directly to the outdoor heat exchanger bypassing the indoor heat exchanger and the second mode of defrost is accomplished by operating the refrigeration circuit in the cooling mode. An intermediate header is provided in a heat exchanger having different circuiting depending upon the mode in which it is operated. The intermediate header acts to provide hot gas to each circuit of the heat exchanger when it is being defrosted and to supply refrigerant in parallel to all the circuits of the heat exchanger when it acts as an evaporator. The intermediate header acts to conduct refrigerant between circuits of the heat exchanger such that some of the circuits of the heat exchanger may be in series when the heat exchanger serves as a condenser.

DESCRIPTION OF THE PREFERRED EMBODIMENT

The embodiment as described herein will refer to a heat pump system capable of reverse cycle operation. The application herein of the nonreverse defrost utilizing a solenoid valve to prevent refrigerant flow from the heat exchanger not being defrostable finds like applicability in other refrigeration circuits having heat exchangers which require defrosting. Portable transportation units, coolers, refrigeration display cases, freezers and other types of devices may utilize the refrigeration circuit as incorporated herein.

Figure 1:
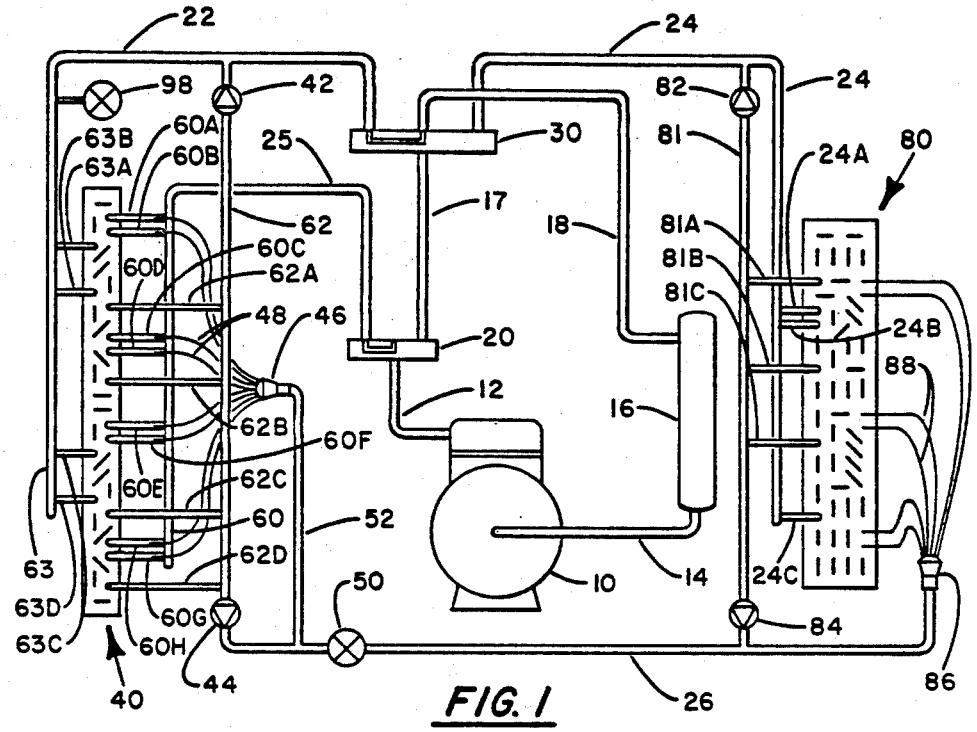
FIG. 1 is a schematic view of the heat pump circuit incorporating the claimed invention.

Referring now to FIG. 1 there can be seen a heat pump system having compressor 10 connected by discharge line 12 to three-way valve 20. Three-way valve 20 is shown in a position wherein gaseous refrigerant is directed from three-way valve 20 through line 17 to reversing valve (or four-way valve) 30. Reversing valve 30 is connected by line 22 to header 63, pressure switch 98 and check valve 42, by line 18 to accumulator 16 which is connected by suction line 14 to compressor 10 and by line 24 to feeder tubes 24A through 24D and check valve 82.

Outdoor heat exchanger 40 has, as shown in FIG. 1, eight circuits therein. Header 63 connected to line 22 has four feeder tubes labeled 63A through 63D for supplying refrigerant to these circuits. Intermediate header 60 is connected by line 25 to three-way valve 20 and has feeder tubes 60A through 60F connecting header 60 to each of the circuits of the outdoor heat exchanger 40. Header 62 is connected by feeder tubes 62A through 62D to the four circuits of outdoor heat exchanger 40 to which header 63 is not connected. Header 62 has check valve 42 mounted at one end thereof to prevent refrigerant flow from line 22 into header 62. Check valve 44 is mounted in the opposite end of header 62 to prevent refrigerant flow from interconnecting line 26 into header 62. Distributor 46 connected by line 52 to solenoid valve 50 has emanating therefrom eight capillary tubes which are shown passing through header 60 and discharging refrigerant into feeder tubes 60A through F.

Indoor heat exchanger 80 is shown having six circuits. Line 24 has feeder tubes 24A through C connecting line 24 to three circuits of the indoor heat exchanger. Header 81 has three feeder tubes 81A through 81C connected to three other circuits of the indoor heat exchanger 80. Distributor 86 is connected to line 26 and has six capillary tubes 88 extending therefrom, one into each of the six circuits of the indoor heat exchanger. Header 81 has check valve 82 mounted in one end thereof to prevent refrigerant flow from line 24 into header 81. Check valve 84 is mounted at the other end of header 81 to prevent refrigerant flow from line 26 into header 81.

Solenoid 50 is mounted in line 26 to control refrigerant flow between interconnecting line 26 and line 52 during the first stage of defrost operation. The solenoid valve is in the open position permitting flow therethrough when the compressor is otherwise energized.

OPERATION

During operation of the refrigeration circuit disclosed in the cooling mode, the three-way valve 20 is positioned such that hot gaseous refrigerant discharged from the compressor flows through the three-way valve into line 17 to four-way valve 30. Four-way valve 30 is positioned such that refrigerant flows from line 17 into line 22 to header 63. Refrigerant then flows from header 63 through the feeder tubes 63A through D to four circuits of outdoor heat exchanger 40. The refrigerant flows then through the four circuits into four of the feeder tubes 60A through H into header 60 and then through the other four of the feeder tubes 60A through H back into the remaining four circuits of outdoor heat exchanger 40. Refrigerant is then discharged from outdoor heat exchanger 40 to header 62 through feeder tubes 62A through 62D. Refrigerant is condensed while flowing through the outdoor heat exchanger by transferring heat energy contained therein to air flowing through the heat exchanger. An outdoor fan driven by a fan motor may be utilized to circulate the air in heat exchange relation with the outdoor heat exchanger.

Once the refrigerant enters header 62 it will flow through check valve 44 into line 26 and then to distributor 86. Refrigerant then flows through six capillary tubes 88 into the six circuits of the outdoor heat exchanger 80, the capillary tubes act to reduce the pressure of the refrigerant such that it may be evaporated absorbing heat energy from the heat transfer media flowing in heat exchange relation with the indoor heat exchanger. The gaseous refrigerant discharged from the indoor heat exchanger is conducted from three of the indoor heat exchanger circuits through feeder tubes 24A through 24C into line 24 back to the four-way valve. Refrigerant from the other three circuits of the indoor heat exchanger is discharged through feeder tubes 81A through 81C into header 81 and through check valve 82 to line 24 and back to reversing valve 30. From reversing valve 30 the gaseous refrigerant is drawn from line 18 into accumulator 16 and then through suction line 14 back to compressor 10 to complete the refrigeration circuit. Consequently, it can be seen that the outdoor heat exchanger acts as a condenser with groups of circuits of the condenser being put in series and the indoor heat exchanger acts as an evaporator with all the circuits being in parallel when the unit is operated in the cooling mode.

When it is desirable to supply heat energy to the area to be conditioned, the heat pump system is operated in the heating mode. In the heating mode, hot gaseous refrigerant is discharged from compressor 10 through discharge line 12 through three-way valve 20 to line 17 and reversing valve 30. Reversing valve 30 as shown in FIG. 1 is in the heating mode position such that the hot gaseous refrigerant received therefrom is conducted through line 24 into the indoor heat exchanger 80. Refrigerant from line 24 is conducted by feeder tubes 24A through 24C into three of the circuits of the indoor heat exchanger. These three circuits are connected one to each of the other three circuits of indoor heat exchanger 80 at the point where the capillaries enter the circuits. Consequently, in the heating mode there are three flow paths in parallel, each flow path having two circuits in series. Hence, the refrigerant enters the indoor heat exchanger through feeder tubes 24A through 24C and is discharged through feeder tubes 81A through 81C into header 81. The refrigerant entering any particular feeder tube travels through two circuits of the indoor heat exchanger before being discharged to header 81. These two circuits are joined at the point where the capillary tubes enter same via a return bend. The refrigerant is condensed in the indoor heat exchanger in the heating mode to give off the heat of condensation to the heat transfer media flowing in heat transfer relation therewith. The condensed refrigerant is then conducted from header 81 through check valve 84 into line 26.

Assuming solenoid valve 50 is in the open position, refrigerant from the indoor heat exchanger is conducted through solenoid valve 50 through line 52 through distributor 46 and then directed through the eight capillaries 48 into feeder tubes 60A through 60F. Refrigerant enters each of the circuits in the outdoor heat exchanger through the feeder tubes, is evaporated absorbing heat energy from the heat transfer media in heat transfer relation therewith. From the outdoor heat exchanger the refrigerant is conducted through feeder tubes 63A through 63D into header 63 to line 22, back to the four-way valve and through the four feeder tubes 62A through 62D into header 62 through check valve 42 through line 22 and back to the four-way valve. Refrigerant is then conducted back to the compressor through line 18, accumulator 16 and suction line 14 to complete the refrigeration cycle such that the indoor heat exchanger serves as a condenser and the outdoor heat exchanger serves as an evaporator.

In the defrost mode of operation the hot gaseous refrigerant from the compressor is discharged through discharge line 12 to three-way valve 20. The position of three-way valve 20 is changed such that the hot gaseous refrigerant is conducted through line 25 to header 60. From header 60 the hot gaseous refrigerant feeds into all eight circuits of outdoor heat exchanger 40 through feeder tubes 60A through 60F. Refrigerant flows from the outdoor heat exchanger through feeder tubes 63A through 63D to header 63 and through feeder tubes 62A through 62D into header 62. Both headers feed back to line 22 to the reversing valve in the heating mode position and therefrom to line 18, accumulator 16 and back to compressor 10. Consequently, the only heat energy added to the refrigerant as it flows through this single heat exchanger path is that energy of compression created by powering the compressor. During operation in this first defrost mode solenoid valve 50 is closed to prevent refrigerant flow between the indoor heat exchanger and the outdoor heat exchanger. Consequently, the half of the circuit including indoor heat exchanger 80, connecting line 26, solenoid valve 50 and reversing valve 30 is effectively isolated from the remainder of the system as the compressor operates to conduct hot gaseous refrigerant to the outdoor heat exchanger to melt the frost accumulated thereon.

If, after a predetermined time interval, the first defrost mode fails to remove all the frost from the heat exchanger then three-way valve 20 is returned to the normal operating position, solenoid valve 50 is opened and the reversing valve 30 is switched to the cooling mode such that the outdoor heat exchanger is operated as a condenser with the indoor heat exchanger being operated as an evaporator. During this second mode of defrost operation the remainder of frost buildup on the heat exchanger, if any, should be removed. Pressure switch 98, shown in attached FIG. 1 is used to monitor the pressure of the refrigerant being discharged from the outdoor heat exchanger during the first mode of defrost when the three-way valve is energized. This pressure switch is used to discontinue defrost if a predetermined pressure rise is accomplished.

CONTROL CIRCUIT

Figure 2:
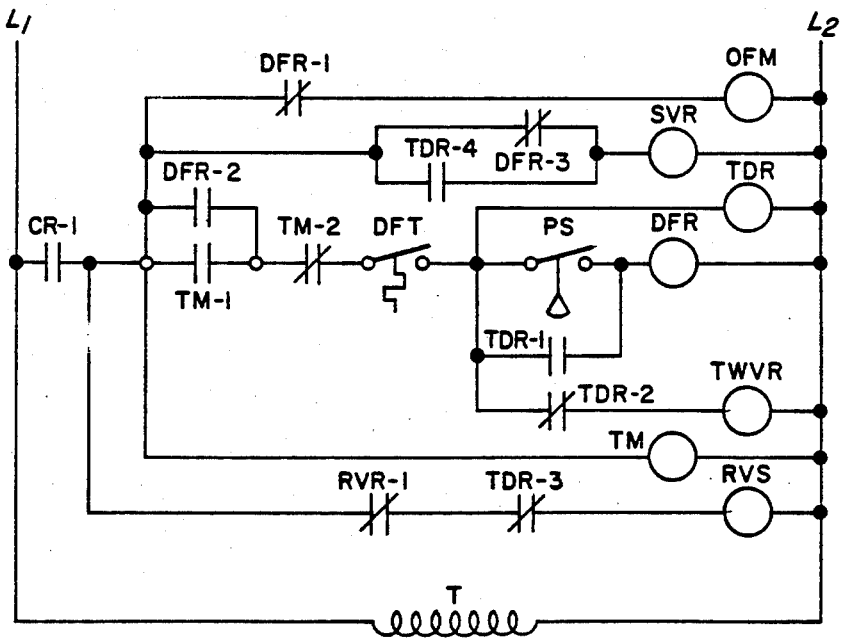
FIG. 2 is a schematic wiring diagram of a portion of the controls of the heat pump system of FIG. 1.

In FIG. 2 there is disclosed a partial simplified wiring schematic of a control circuit for use with the heat pump system of FIG. 1. It can be seen in FIG. 2 that power is supplied between L-1 and L-2 such that outdoor fan motor OFM and the solenoid valve SVR are energized under normal operating conditions since the defrost relay contacts DFR-1 and DFR-3 are normally closed and the defrost relay DFR is not energized. Timer motor TM is also normally energized when the system is operated. Additionally, during the heating season, the reversing valve solenoid RVS is normally energized through normally closed contacts RVR-1 and normally closed contacts timed delay relay contacts TDR-3. When the reversing valve solenoid is energized it is in the heating mode as shown in FIG. 1. Time delay relay contacts TDR-3 are shown in a normally closed position. The RVR-1 contacts are contacts of the reversing valve relay of the portion of the control circuit not shown which are normally closed when the system is placed in the heating mode. A single coil of transformer T-1 is shown to indicate that this is the power circuit portion of the wiring diagram and that the lesser voltage control portion might be conected via the transformer at that location.

Defrost relay DFR is connected between L-1 and L-2 by normally open timer motor contacts TM-1, normally closed timer motor contacts TM-2, defrost thermostat DFT and pressure switch PS. Control relay contacts CR-1 are provided to energize the circuit when the compressor is energized. Normally open defrost relay contacts DFR-2 are mounted in parallel with normally open timer motor contacts TM-1. Normally open time delay relay contacts TDR-1 are mounted in parallel with pressure switch PS. The time delay relay is mounted in series with the timer motor contacts TM-1, normally closed timer motor contacts TM-2 and a defrost thermostat DFT. The three-way valve relay TWVR is mounted in series with the normally open timer motor contacts TM-1 and normally closed timer motor contacts TM-2, defrost thermostat DFT, and normally closed time delay relay contacts TDR-2. The solenoid valve relay SVR is connected in series with normally closed defrost relay contacts DFR-3 connected in parallel with normally open time delay relay contacts TDR-4.

CONTROL CIRCUIT OPERATION

When the heat pump system is operated in the cooling mode, operation is other than as generally shown in the partial the wiring schematic. When operation is in the heating mode, reversing valve relay, not shown, energizes reversing valve relay contacts RVR-1 to close the RVR-1 contacts. When the RVR-1 contacts close, the reversing valve solenoid is energized since the time delay relay contacts TDR-3 are in a normally closed position. This places the reversing valve solenoid in the heating mode position which positions the reversing valve such that refrigerant is condensed in the indoor heat exchanger to supply heat to the enclosure to be conditioned.

In addition, when the compressor motor is operating and control relay contacts CR-1 are closed, an outdoor fan motor circulating ambient air through the outdoor heat exchanger is energized and the liquid line solenoid valve relay SVR holding the solenoid valve in the open position are energized such that the refrigerant may flow through line 26 to the outdoor heat exchanger. Normally closed defrost relay contacts DFR-1 and DFR-3 remain closed upon startup and the outdoor fan motor is operated as is the solenoid valve relay. Timer motor TM is additionally energized during periods of operation of the compressor.

Upon an elapsed period of time, timer motor contacts TM-1 close for a short period while timer motor contacts TM-2 remain closed such that if during that short interval, i.e. 10 seconds, the defrost thermostat DFT is closed because the temperature of the refrigerant or coil is at a point where frost is formed and the pressure switch is in the closed position then the defrost relay will be energized. If either the defrost thermostat is open or the pressure switch is open, the defrost relay will not be energized and the timer motor will start another cycle to ascertain whether or not defrost should be engaged.

If the defrost relay is energized, then defrost relay contacts DFR-2 will close providing a circuit through normally open defrost relay contacts DFR-2, normally closed timer motor contacts TM-2, normally closed defrost thermostat and the pressure switch to energize the defrost relay and to hold same energized. After a predetermined maximum defrost period, timer motor contacts TM-2 will open thereby discontinuing defrost regardless of the position of the defrost thermostat and the pressure switch.

When the defrost relay is energized, normally closed defrost relay contacts DFR-1 and DFR-3 open discontinuing operation of the outdoor fan motor OFM and allowing the solenoid valve relay SVR to become de-energized closing the solenoid valve. With the outdoor fan motor discontinued, heat transfer between the outdoor heat exchanger and the ambient air is restricted such that the hot gaseous refrigerant being circulated therethrough may more quickly defrost the heat exchanger. Additionally, the second set of defrost relay contacts DFR-2 are closed providing a circuit to maintain the defrost relay energized. Upon the defrost thermostat closing, the time delay relay TDR is energized which results in the series of time delay relay contacts changing position. The time delay relay acts to allow a predetermined period such as three minutes to elapse and then the various time delay relay contacts change position. At the expiration of that period, the normally open time delay relay contacts TDR-1 close bypassing pressure solenoid switch PS to maintain the defrost relay energized. The normally closed time delay relay contacts TDR-2, upon the elapse of the predetermined period, open discontinuing operation of the three-way valve relay which causes the three-way valve to shift position back to that position where the hot gaseous refrigerant is discharged to the reversing valve. Additionally, normally closed time delay relay contacts TDR-3 open de-energizing the reversing valve solenoid such that the reversing valve is placed in the cooling mode position. In this position, the compressor is operated as it would be in the cooling mode and the outdoor heat exchanger serves as a condenser such that heat energy is supplied thereto from the indoor heat exchanger. Also, normally open time delay relay contacts TDR-4 close energizing the solenoid valve relay SVR opening solenoid valve 50 to allow refrigerant to flow between the heat exchangers.

The use of the pressure switch to determine when to discontinue defrost operation is bypassed in the second mode of defrost since the pressure detected is the discharge pressure of the compressor. During the first mode of defrost operation the pressure detected by pressure switch 98 is the pressure of the refrigerant after it is passed through the outdoor heat exchanger and has been cooled by transferring heat energy thereto. Consequently, in the first nonreverse mode of defrost the opening of either the defrost thermostat or the pressure switch will result in defrost being terminated. However, in the second mode of defrost operation, reverse cycle, only the opening of the defrost thermostat will terminate defrost operation. Naturally, the expiration of the maximum time period as set by the timer motor through normally closed timer motor contacts TM-2 will also discontinue defrost operation in either mode.

The apparatus and controls as presented provide an energy efficient demand responsive defrost system. Under normal operating conditions, the defrost thermostat will close indicating a defrost need whenever the ambient temperature drops below the set point of the defrost thermostat. With previous defrost systems, the heat pump would switch to defrost after the expiration of the preset time period whenever the ambient temperature was below the set point of the defrost thermostat.

The apparatus described herein cycles hot gas to the coil to be defrosted when the defrost thermostat is closed and the time interval has expired. This hot gas will quickly raise the heat exchanger temperature absent or with only minimal frost accumulation such that the pressure switch terminates defrost before the heat pump is operated in the cooling mode. Hence the energy lost by reversing system operation is saved if defrost is not really necessary or the defrost thermostat is closed only because the ambient temperature is below the defrost thermostat set point. This system provides then for a demand responsive defrost system because reverse cycle operation is prevented absent the necessity therefore.

The refrigeration system herein has been described with reference to a heat pump system. It is understood that this invention has like applicability to other types of refrigeration circuits requiring heat exchanger defrost. Additionally, a specific set of controls have been described for effecting operation of this defrost system. It is to be understood that these controls may be modified to otherwise control the defrost method as claimed. The invention has been described with reference to the preferred embodiment, however, it is to be understood that variations and modifications can be made within the spirit and scope of the invention.

We claim:

1. A method of defrosting a refrigeration system having a closed refrigeration circuit including a first heat exchanger, a second heat exchanger, an expansion device, a compressor and interconnecting lines which comprises the steps of:

sensing a frost accumulation on the second heat exchanger;

diverting in response to a need for defrost being sensed hot gaseous refrigerant from the compressor to the second heat exchanger bypassing the first heat exchanger;

preventing the refrigerant in the first heat exchanger from flowing to the second heat exchanger during the step of diverting;

discontinuing the steps of diverting and preventing after a predetermined time interval or upon the step of sensing detecting no further need for defrost; and switching the reversing valve to change the mode of operation of the refrigeration circuit simultaneously with or after the step of discontinuing if the predetermined time period has elapsed and the step of sensing continues to detect a need for defrost.

2. The method as set forth in claim 1 wherein the second heat exchanger has a plurality of circuits and the step of diverting includes;

directing hot gaseous refrigerant from the compressor prior to the reversing valve through all of the circuits of the second heat exchanger simultaneously.

3. The method as set forth in claim 1 wherein the step of sensing comprises the steps of:

measuring a temperature indicative of the frost accumulation on the second heat exchanger; and sensing the pressure of the refrigerant being discharged from the second heat exchanger during defrost.

4. A method of controlling the operation of a heat pump system having a primary refrigeration circuit with a compressor, three-way valve, reversing valve, first heat exchanger, second heat exchanger, expansion means associated with each heat exchanger, and the appropriate interconnecting means and a secondary refrigeration circuit including the compressor, three-way valve, second heat exchanger, a four-way valve and appropriate interconnecting conduits which comprises the steps of:

energizing the compressor upon a demand for heating to utilize the primary refrigeration circuit such that the three-way valve and the reversing valve are positioned to have refrigerant from the compressor discharged through the three-way valve and the reversing valve to the first heat exchanger serving as a condenser, through the expansion means to the second heat exchanger serving as an evaporator and through the reversing valve back to the compressor;

detecting a need for defrost of the second heat exchanger;

repositioning the three-way valve in response to the step of detecting to direct refrigerant through the secondary circuit including from the compressor through the three-way valve to the second heat exchanger for defrost of same, and through the reversing valve back to the compressor; and preventing the flow of refrigerant from the first heat exchanger to the second heat exchanger during that time when the three-way valve is repositioned in response to the step of detecting.

5. A demand responsive defrost method for a reverse cycle refrigeration system having a compressor, indoor heat exchanger, outdoor heat exchanger, reversing means and interconnecting lines which comprises the steps of periodically generating a defrost signal if the temperature of a frost sensitive sensing device is within the temperature range at which frost may accumulate on the outdoor heat exchanger;

circuiting hot gaseous refrigerant between the compressor and the outdoor heat exchanger to supply heat energy to the outdoor heat exchanger in response to the defrost signal;

sensing whether the temperature of the refrigerant flowing through the outdoor heat exchanger is sufficiently high to indicate a lack of frost on the outdoor heat exchanger terminating the defrost signal if the step of sensing indicates the lack of frost accumulation on the outdoor heat exchanger; and initiating reverse cycle operation of the heat pump system to supply heat energy to the outdoor heat exchanger after the step of circuiting has continued for a preselected time period and the step of terminating the defrost signal has not occurred within that time period.

* * * * *